United States Patent [19]

Protacio et al.

[11] 4,419,967

[45] Dec. 13, 1983

[54] METHOD AND APPARATUS FOR UTILIZING ETHANOL OF ANY PURITY AS A FUEL IN 4-STROKE INTERNAL COMBUSTION ENGINES

[75] Inventors: Alfredo C. Protacio, Project Sta. Barbara Sangley Point, Cavite City, Philippines; Ramon V. Navarro, Cavite City, Philippines; Eliseo M. Rio, Jr., Cavite City, Philippines; Antonio D. Alonte, Cavite City, Philippines; Felix J. Pascual, Cavite City, Philippines

[73] Assignee: Alfredo C. Protacio, Cavite City, Philippines

[21] Appl. No.: 430,692

[22] Filed: Sep. 30, 1982

Related U.S. Application Data

[63] Continuation of Ser. No. 153,696, Jun. 12, 1980, abandoned.

[30] Foreign Application Priority Data

Jun. 14, 1979 [PH] Philippines ..... 22666

[51] Int. Cl.[3] ..... F02B 75/12

[52] U.S. Cl. ..... 123/1 A; 123/198 A

[58] Field of Search ..... 123/1 A, 198 A, 25 R, 123/25 A, 25 L

[56] References Cited

U.S. PATENT DOCUMENTS

| | | | |
|---|---|---|---|
| 2,300,774 | 11/1942 | Cartmell | 123/25 L |
| 2,602,435 | 7/1952 | Boyan | 123/25 R |
| 2,692,585 | 10/1954 | Dunnigan | 123/25 A |
| 3,537,434 | 11/1970 | Herpin | 123/25 L |
| 3,655,169 | 4/1972 | Goldfarb | 123/25 A |
| 3,716,040 | 2/1973 | Herpin | 123/25 R |
| 3,790,139 | 2/1974 | Stephenson et al. | 123/1 A |
| 3,865,907 | 2/1975 | Rock | 123/25 L |
| 4,076,002 | 2/1978 | Mellquist et al. | 123/25 L |
| 4,141,323 | 2/1979 | Hart | 123/25 B |

*Primary Examiner*—Charles J. Myhre
*Assistant Examiner*—E. Rollins Cross
*Attorney, Agent, or Firm*—Auslander & Thomas

[57] ABSTRACT

A method and apparatus for thoroughly mixing ethanol and air in the right proportion for efficient combustion in the engine consisting the active steps of aspirating the air by means of the vacuum pressure developed by the piston displacement of the engine in the intake stroke; bubbling said air into the liquid ethanol thereby evaporating said ethanol; mixing them in a homogeneous air-fuel flammable mixture; and introducing the mixture into the engine's intake manifold.

3 Claims, 2 Drawing Figures

METHOD AND APPARATUS FOR UTILIZING ETHANOL OF ANY PURITY AS A FUEL IN 4-STROKE INTERNAL COMBUSTION ENGINES

This application is a continuation of application Ser. No. 153,696 filed June 12, 1980 now abandoned.

BACKGROUND OF THE INVENTION

This invention relates to a method and apparatus for thoroughly mixing ethanol and air in the right proportion for efficient combustion inside the engine's combustion chamber utilizing evaporator and the suction pressure of the intake manifold of said engine.

In the present utilization of ethanol as a fuel, either alone or blended with gasoline, anhydrous ethanol (100% purity) is required. The production of anhydrous ethanol using conventional technology is difficult and expensive due to its azeotropic property wherein at 95% purity, water and ethanol evaporate and distill in the same proportion, thereby requiring special processes and equipment. The present use of ethanol gasoline blends introduces operating difficulties especially in starting, accelerating, and vapor lock. Likewise, the use of regular ethanol using existing gasoline carburetor suffers from the same difficulties. The ethanol or ethanol-gasoline blend is inducted in an atomized state by the rush of intake air into the engine carburetor and through the intake manifold wherein the air-fuel mixture may not be thoroughly in its vaporized flammable state, still containing droplets of gasoline, water, and ethanol, thereby resulting in an incomplete combustion of the fuel with smoke and carbon deposit and the corrosive effect of water.

The method and apparatus of this invention contemplates of thoroughly mixing ethanol and air in the right proportion for efficient combustion in the engine. The air is aspirated by the vacuum developed by the piston displacement of the engine in the intake stroke and is bubbled into the ethanol thereby evaporating the ethanol and thoroughly mixing them in a homogeneous air-fuel flammable mixture and introducing it into the engine intake manifold free of any water moisture and any liquid fuel droplets. Ethanol has a unique azeotropic property wherein its affinity with water is greatly reduced as pressure is reduced. Consequently, when a vacuum is created over a container of ethanol, ethanol vaporizes more readily leaving behind the water initially in solution with it. Because when ethanol vaporizes, it needs about 370 BTU of heat per pound which heat is partly taken from the water in solution greatly reducing its temperature thereby suppressing its vaporization. At the same time, the air is also filtered of solid impurities as it is bubbled into the ethanol. Water moisture in air is condensed as a consequence of the low temperature (about 50° F.) of the liquid ethanol and water in solution. The combustion of the ethanol using this method is perfect without any unburned fuel residue (carbon soot).

The device using this method will be much simpler in design and fewer parts and controls for the need of a venturi to induct the fuel may be eliminated. The possibility of flooding the engine is also eliminated. This method and device will separate any water contamination of the ethanol due to the fact that ethanol is more volatile than water and in the process of vaporization it will in effect suppress the vaporization of water present and in fact, will condense any water vapor present in the air. As a consequence, the thermal efficiency is improved significantly.

OBJECTIVES

The objectives of this invention are the following:

1. to utilize ethanol alone in any purity directly as fuel in 4-stroke combustion engine to do away with the tedious and expensive process of producing anhydrous ethanol;
2. to separate water from ethanol in the process of vaporizing the ethanol thereby eliminating the possibility of water vapor and/or droplets entering the engine combustion chamber;
3. to simplify and improve the carburetion process of ethanol ensuring a thoroughy homogeneous air-ethanol vapor mixture; and
4. to improve the thermal efficiency of the engine.

VIEWS OF THE DRAWINGS

FIG. 1 shows the diagrammatic representation of the apparatus that can facilitate the thorough mixing of ethanol and air; and FIG. 2 shows the diagrammatic attachment of the vaporizing apparatus to the existing carburetor of a four-stroke internal combustion engine.

DETAILED DESCRIPTION

Figure 1:
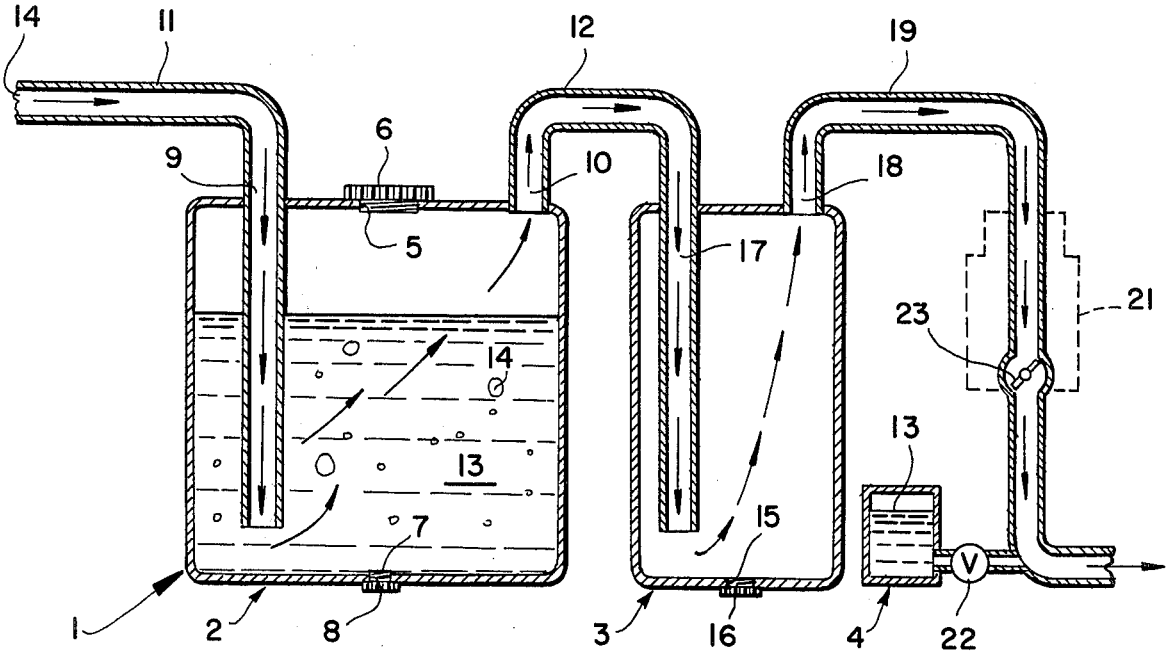
Figure 2:
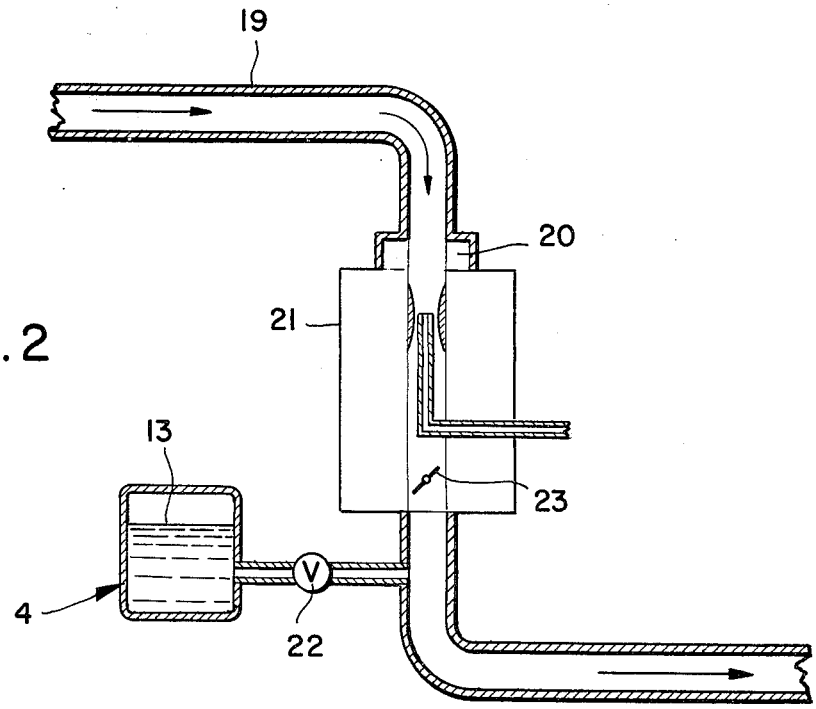

Referring now to the different views of the drawings, there is shown an apparatus 1 that is adapted to be attached to the engine's carburetor air intake in order to utilize ethanol of any impurities as a fuel for said engine. Said apparatus comprising an ethanol vaporizing tank 2, a surge tank 3, and a secondary tank 4.

The ethanol vaporizing tank 2 is basically an enclosed container having a filling opening 5 with cap 6, a discharge opening 7 with drain plug 8, an air inlet port 9, and a mixed air-ethanol outlet port 10. Fittingly attached to the air inlet port 9 is a pipe 11 that extends downward inside said tank 2 close to the bottom thereof. On the top cover of said tank is fitted another pipe 12 which is adapted to discharge a volatile mixture of air and ethanol vapors. It will be noted that when the tank 2 is filled with liquid ethanol 13 to a certain level above the open end of pipe 11 and air 14 is sucked in by way of the pipe, the suck air will be bubbled thru the liquid ethanol thereby creating greater surface areas of vaporization for said liquid. Furthermore, the suction pressure lowers the surface tension of the liquid and facilitates easy evaporation.

After a period of operation the liquid ethanol will be depleted of its volatile components and vaporized to a very lean mixture. When this condition has been attained, the drain plug 8 at the bottom of the tank 2, may now be opened to allow the discharge of water and other impurities of the ethanol. After the removal of non-volatile liquids, the tank 2 is again filled with a fresh supply of alcohol 13.

The liquid condensate tank 3 used in this invention is basically an enclosed container having an opening 15 at the bottom with a drain plug 16, an air entry port 17, and an air discharge port 18. Fitted to the air inlet port 17 is the other end of the U-shaped pipe 12 that extends downward inside the liquid condensate tank 3 and close to the bottom thereof. On the air outlet port 18 is fitted a pipe 19 that terminates to the air inlet 20 of the existing engine's carburetor 21. After attaching the liquid condensate tank 3, the wiper connection below the carburetor's throttle valve 23 is fitted with a by-pass port 22 and connected to a secondary tank 4. Inside this tank 4 may now be poured gasoline or ethanol 13 which can be utilized for starting and accelerating purposes.

When these attachments are placed, then the gasoline supply line going to the engine's carburetor is shut off. To revert to the use of gasoline fuel, the ethanol carburetor device 1 and secondary tank 4 connections are simply removed and the gasoline supply line opened.

The method of this invention comprises of the active steps of aspirating the air by means of the vacuum pressure developed by the piston displacement of the engine on the engine's intake stroke; bubbling said air into the liquid ethanol thereby evaporating said ethanol; mixing them in a homogeneous air-fuel flammable mixture; and introducing the mixture into the engine's intake manifold.

OPERATION

The ethanol vaporizing tank 2 is first filled with liquid ethanol to approximately three-fourth of its volume and afterwards tightly covered to prevent the escape of the volatile vapors upon vaporization. Then the air outlet pipe 12 from the vaporizing tank 2 is fitted to the air-inlet port 17 of the liquid condensate tank 3 and the air discharge pipe 19 from the liquid condensate tank directly fitted to the air intake port 20 of an existing gasoline carburetor 21. The secondary tank 4 is also filled with either gasoline or ethanol and the by-pass port 22 slightly opened to allow the flow of a small amount of gasoline to prime the system.

When the engine is started, the gasoline primer initially starts the engine thereby causing the suction of air from the atmosphere by way of the liquid condensate tank 3 and the vaporizing tank 2. As the fresh air flows thru the liquid ethanol 13, said air causes the ethanol to evaporate due to the decrease surface tension caused by the negative pressure and the increase of surface areas caused by the air bubbles. This air and volatile ethanol vapors then mix together and are allowed to pass thru the liquid condensate tank 3. Along the pathway of the vapor some of the heavier vapors and water droplets are condensed and fall back to the vaporizing tank 2 while the lighter ones condense and fall at the liquid condensate tank 3 and further evaporated. Inside the liquid condensate tank 3, further mixing and evaporation take place thereby facilitating a thoroughly mixed air-fuel flammable mixture which when sucked by the engine would burn with an almost perfect combustion.

After starting, the engine may be accelerated by means of the throttle valve 23 of the engine's carburetor aided by the secondary tank's by-pass valve 22.

The system may be drained of the water and other residues by means of the two drain plugs 8 and 16 and refilled by means of the filling port 5 on the ethanol vaporizing tank 2.

Having fully disclosed our invention, what we claim and desire to be protected by a Letters Patent is:

1. A method adapted to utilize non-anhydrous ethanol as a fuel in an internal combustion engine comprising the active steps of: aspirating air by means of vacuum pressure developed by piston displacement of an engine on an intake stroke, bubbling said air into liquid ethanol contained in a vaporizing container, said vaporizing container including an air inlet pipe extending downward inside said vaporizing container to close to the bottom thereof, an air outlet pipe in the cover of said container, passing said bubbled air through said vaporizing container's air outlet pipe into a liquid condensate tank, said vaporizing container's outlet pipe extending downwardly inside said liquid condensate tank to close to the bottom thereof; said liquid condensate tank further including an air outlet pipe in the cover of said tank, thereby evaporating ethanol in said vaporizer container and said condensate tank and mixing said air and ethanol vapors in order to produce a homogeneous air-fuel flammable mixture, and introducing said flammable mixture into said engine's intake manifold free from moisture and ethanol droplets.

2. A vaporizing apparatus for effectively utilizing ethanol as fuel in an internal combustion engine comprising: an enclosed vaporizing container adapted to hold liquid ethanol and having a liquid inlet means; liquid discharge means; an air inlet port; said air inlet port including a downwardly extending air inlet pipe; said air inlet pipe extending inside said vaporizing container to close to the bottom thereof; an air outlet pipe in the cover of said vaporizing container, a condensate tank; said air outlet pipe of said vaporizing container extending into said condensate tank to close to the bottom of said condensate tank; an outlet pipe in the cover of said condensate tank; said condensate tank further including liquid discharge means; said outlet pipe of said condensate tank extending to the inlet port of an engine's carburetor, and said carburetor including a throttle valve adapted to control flow, whereby air and vapor from said vaporizer container and condensate tank are mixed to produce a flammable mixture free from moisture and ethanol droplets.

3. The apparatus of claim 2 including a secondary tank, a by-pass valve, said by-pass valve attached after the throttle valve of said carburetor, said secondary tank with said by-pass valve adapted to supply a priming charge for starting and accelerating said engine.

* * * * *